US006811677B2

(12) United States Patent
Aune et al.

(10) Patent No.: US 6,811,677 B2
(45) Date of Patent: Nov. 2, 2004

(54) ELECTROLYTIC CELL FOR THE PRODUCTION OF ALUMINUM AND A METHOD FOR MAINTAINING A CRUST ON A SIDEWALL AND FOR RECOVERING ELECTRICITY

(75) Inventors: Jan Arthur Aune, Enebakk (NO); Kai Johansen, Kristiansand (NO); Per Olav Nos, Asker (NO)

(73) Assignee: Elkem ASA (NO)

( * ) Notice: Subject to any disclaimer, the term of this patent is extended or adjusted under 35 U.S.C. 154(b) by 0 days.

(21) Appl. No.: 10/297,412

(22) PCT Filed: May 29, 2001

(86) PCT No.: PCT/NO01/00221

§ 371 (c)(1),
(2), (4) Date: May 16, 2003

(87) PCT Pub. No.: WO01/94667

PCT Pub. Date: Dec. 13, 2001

(65) Prior Publication Data

US 2003/0183514 A1 Oct. 2, 2003

(30) Foreign Application Priority Data

Jun. 7, 2000 (NO) ..... 20002889

(51) Int. Cl.[7] ..... C25C 3/20; C25B 15/00; B01D 59/40; H01M 8/12

(52) U.S. Cl. ..... 205/396; 204/241; 204/243.1; 204/244; 204/247.5; 429/26

(58) Field of Search ..... 205/396; 204/243.1, 204/244, 241, 247.5; 429/26

(56) References Cited

U.S. PATENT DOCUMENTS 4,049,511 A 9/1977 Alder et al.
4,222,841 A * 9/1980 Miller ..... 204/247
4,592,820 A 6/1986 McGeer
4,608,134 A * 8/1986 Brown ..... 205/378
4,608,135 A * 8/1986 Brown ..... 205/396
4,674,728 A * 6/1987 Aune et al. ..... 266/193
4,749,463 A 6/1988 Holmen
4,865,701 A * 9/1989 Beck et al. ..... 205/375
6,251,237 B1 * 6/2001 Bos et al. ..... 204/241

FOREIGN PATENT DOCUMENTS

EP 0047227 A2 3/1982
GB 2076428 A 12/1981
SU 996520 A 2/1983
SU 1442563 A 12/1988
SU 1693126 A1 11/1991

* cited by examiner

*Primary Examiner*—Donald R. Valentine
(74) *Attorney, Agent, or Firm*—Muserlian, Lucas and Mercanti

(57) ABSTRACT

The present invention relates to an electrolytic cell for the production of aluminum comprising an anode and an electrolytic tank where the electrolytic tank comprises an outer shell made from steel and carbon blocks in the bottom of the tank forming the cathode of the electrolytic cells. At least a part of the sidewall of the electrolytic tank consists of one or more evaporation cooled panels, and wherein high temperature, heat resistant and heat insulating material is arranged between the evaporation cooled panels and the steel shell. The invention also includes a method for maintaining a crust on the sidewall of the tank and for recovering heat from the cooling medium inside the panel for transformation into electrical energy.

22 Claims, 3 Drawing Sheets

Figure 1:
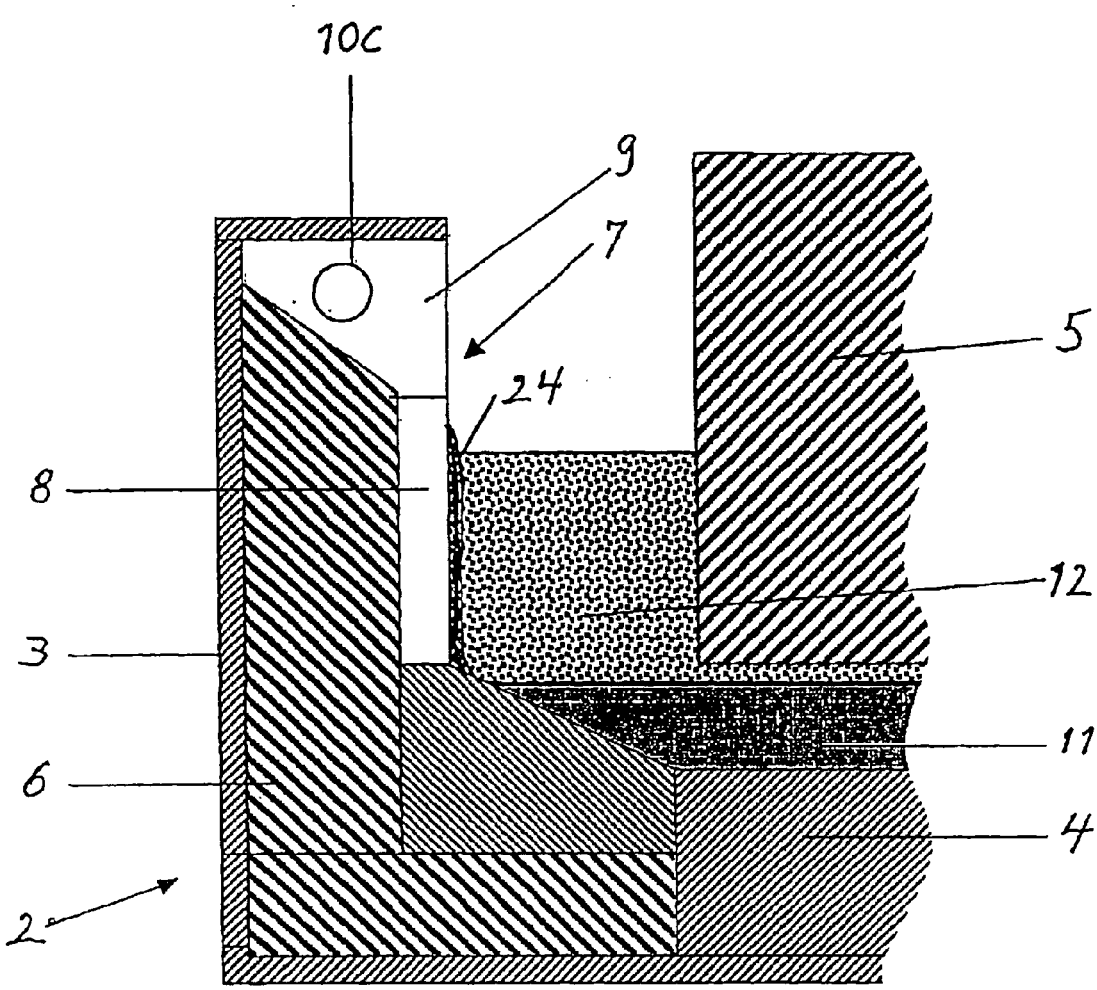

ELECTROLYTIC CELL FOR THE PRODUCTION OF ALUMINUM AND A METHOD FOR MAINTAINING A CRUST ON A SIDEWALL AND FOR RECOVERING ELECTRICITY

FIELD OF INVENTION

The present invention relates to an electrolytic cell for the production of aluminium, a method for maintaining a crust on the sidewall of an electrolytic cell for producing aluminum and a method for recovering electricity from an electrolytic cell for producing aluminum.

BACKGROUND ART

Aluminium is produced in electrolytic cells comprising an electrolytic tank having a cathode and an anode which is either a selfbaking carbon anode or a plurality of prebaked carbon anodes. Aluminum oxide is supplied to a cryolite-based bath in which the aluminum oxide is dissolved. During the electrolytic process aluminum is produced at the cathode and forms a molten aluminum layer on the bottom of the electrolytic tank with the cryolite bath floating on the top of the aluminum layer. CO-gas is produced at the anode causing consumption of the anode. The operating temperature of the cryolite bath is normally in the range of about 920 to about 950° C.

The electrolytic tank consists of an outer steel shell having carbon blocks in the bottom. The blocks are connected to electrical busbars whereby the carbon blocks function as a cathode. The sidewalls of the electrolytic tank are generally lined with refractory material against the steel shell, and a layer of carbon blocks or carbon paste is formed on the inside of the refractory material. There are several types of lining materials and ways of arranging the sidewall lining.

During the operation of the electrolytic cell, a crust or ledge of frozen bath forms on the sidewalls of the electrolytic tank. This layer may, during operation of the electrolytic cell, vary in thickness. The formation of this crust and its thickness are critical to the operation of the cell. If the crust becomes too thick, it will disturb the operation of the cell as the temperature of the bath near the walls becomes cooler than the temperature in the bulk of the bath, thereby disturbing the dissolution of aluminum oxide in the bath. On the other hand, if the frozen layer of crust becomes to thin or is absent, the electrolytic bath may attack the sidewall lining of the electrolytic tank, which ultimately can result in failure of the tank. If the bath attacks the sidewalls, the electrolytic cell has to be shut down, the electrolytic tank has to be removed and a new one has to be installed. This is one of the main reasons for reduced average lifetime of electrolytic tanks.

In order to maintain a proper thickness of the frozen layer of electrolytic bath on the sidewall lining, it is necessary to design the sidewall lining in such a way that the flow of heat from the bath through the sidewall lining is sufficiently high to maintain a frozen crust on the inside of the sidewall lining. The heat losses through the sidewalls of the electrolytic tank may thus account for up to 40% of the total heat losses from the electrolytic cell. However, even with a proper design of the sidewall lining it is impossible to obtain and maintain a thin stable layer of frozen bath on this sidewall lining due to variations in bath composition and other process variables not under operator control.

SUMMARY OF INVENTION

It is an object of the present invention to provide an electrolytic cell for the production of aluminum where the heat losses through the sidewalls of the electrolytic tank are partially recovered as electricity and wherein a thin, stable layer of frozen electrolytic bath is obtained and maintained on the inside of the sidewall lining. It is a further object of this invention that the frozen layer is not influenced by differences in temperature of the molten electrolytic bath or of the bath composition.

Accordingly, the present invention relates to an electrolytic cell for the production of aluminum comprising an anode and an electrolytic tank where the electrolytic tank comprises an outer shell made from steel and carbon blocks in the bottom of the tank forming the cathode of the electrolytic cell, said electrolytic cell being characterized in that at least a part of the side wall of the electrolytic tank has one or more evaporation cooled panels, and wherein high temperature, heat resistant and heat insulating material is arranged between the evaporation cooled panels and the steel shell.

According to a preferred embodiment, all the sidewalls of the electrolytic cell are equipped with evaporation cooled panels.

According to another embodiment, the evaporation cooled panels are intended to contain a first cooling medium which has a boiling point in the range between 850 to 950° C., preferably between 900 and 950° C. at atmospheric pressure.

Suitably, the evaporation cooled panels contain molten sodium, a sodium-lithium alloy or zinc as a cooling medium.

According to yet another embodiment of the present invention, each evaporation cooled panel has means, in its upper part, for circulation of a second cooling medium for convective heat removal to condense the cooling medium in the evaporation cooled panel.

According to yet another embodiment of the present invention, the means for circulation of the second cooling medium is a first closed loop, and a part of said first closed loop runs through the upper part of each evaporation cooled panel in the electrolytic cell.

The parts of the first closed loop for the second cooling medium that are not situated inside the upper part of the evaporation cooled panels are preferably arranged in the heat resistant and heat insulating material arranged between the evaporation cooled panels and the steel shell.

The first closed loop for circulating the second cooling medium is preferably connected to a heat exchanger for transferring heat from the second cooling medium to a third cooling medium contained in a second closed loop. After being heated in the heat exchanger, the third cooling medium is pumped through a generator for producing electrical energy. The heat exchanger is preferably arranged in the heat resistant and heat insulating material arranged between the evaporation cooled panels and the steel shell.

The second closed loop for circulating the third cooling medium is preferably connected to heat exchangers for a plurality of electrolytic cell, and more preferably is connected to heat exchangers for all electrolytic cells in a potline.

When operating a potline with a plurality of electrolytic cells according to the present invention, each evaporation cooled panel in an individual cell is set to operate such that the temperature on the side of the panels facing the interior of the electrolytic cells is slightly below the temperature of the molten electrolytic bath, preferably between 2 and 50° C. lower than the temperature of the electrolytic bath. Thus, due to the small temperature drop between the evaporation cooled panels and the molten electrolytic bath, a thin, solid and stable crust of electrolytic bath will form on the side of the evaporation cooled panels facing the molten electrolytic bath. This crust will protect the sides of the evaporation cooled panels facing the molten electrolytic bath. As an example, if the temperature of the electrolytic bath is 940° C., the evaporation cooled panels are set to operate at 920° C. Further, due to the heat resistant and heat insulating material arranged between the evaporation cooled panels and the steel shell, the heat flow through the sidewall is negligible.

Heat will be transferred from the electrolytic bath to each evaporation cooled panel, and the first liquid cooling medium in the lower part of the evaporating cooled panels will transfer this heat to the upper part of the evaporation cooled panels through evaporation of a part of the first liquid cooling medium. In the upper part of the evaporation cooled panels, the vapour will condense as it comes into contact with the first closed loop for circulating the second cooling medium and the heat of condensation will be transferred to the second cooling medium. The condensed first cooling medium will flow down into the lower part of the evaporation cooled panels.

The heat transferred to the second cooling medium will cause a temperature increase of the second cooling medium which is transferred to the third cooling medium in the second closed loop when the second cooling medium passes through the heat exchanger.

The heat transferred from the electrolytic bath to the individual evaporation cooled panels in an electrolytic cell may vary from panel to panel and also with time. In order to be able to transfer the correct amount of heat from each individual evaporation cooled panel, according to the invention, a means for adjusting the temperature or the amount of the second cooling medium running through the upper part of each evaporation panel is arranged in the first closed cooling loop. This can be done in a number of ways. Thus parts of the first closed loop for circulating the second cooling medium are equipped with electric heating elements to heat the second cooling medium just before it enters into the upper part of each of the evaporation cooled panels. In another embodiment, there are arranged valves and pipes for bypassing a part of the second cooling medium in order to adjust the amount of second cooling medium which enters into the first closed loop inside the upper part of each evaporation cooled panel.

In a third embodiment, there may be arranged adjustable valves on the part of the first cooling loop for the second cooling medium in order to adjust the amount of the second cooling medium flowing into the part of the first closed cooling loop situated inside the upper part of each evaporation cooled panel.

The individual control of heat transfer for each evaporation cooled panel, assures that the transport of heat at all times will be controlled in such a way that a thin frozen layer of electrolytic bath is maintained on the sides facing the electrolytic bath of all the evaporation cooled panels in each electrolytic cell.

The second cooling medium in the first closed loop is preferably a gas such as carbon dioxide, nitrogen, helium or argon operating at a lower temperature than the temperature in the first cooling medium.

As mentioned above, the heat from the second closed loop for circulating the third cooling medium is circulated through heat exchangers associated with the heat exchangers of a plurality of electrolytic cells. The third cooling medium is preferably a gas such as helium, neon, argon, carbon monoxide, carbon dioxide or nitrogen, which, after having been circulated through the heat exchangers for all the electrolytic cells in a potline, gradually increases in temperature and the pressure. The heated third cooling medium is forwarded to a gas turbine connected to a generator for producing electrical current, whereafter the cooled gas leaving the turbine is recycled in the second closed loop. This closed loop transfer of thermal energy can give a conversion of thermal energy to electricity with an efficiency of 45% or more. Based on this electric energy recycling, the total current efficiency of the electrolytic cells is vastly improved.

Since the present invention makes it possible to control the temperature at the boundry between the evaporation cooled panels and the molten electrolytic bath, thereby securing a thin, solid layer of electrolytic bath on the side of the panels facing that electrolytic bath, the risk of destroying the sidewalls of the electrolytic cell is eliminated. The average lifetime of the electrolytic cells is thus substantially increased.

Further, the avoidance of the conventional large crusts of solid electrolytic bath on the sidewalls gives a better efficiency and control of the cell operation due to the fact that the temperature of the molten electrolytic bath along the sidewalls will differ insignificantly from the temperature in the bulk of the bath. This will give a faster solution of added aluminum oxide as the oxide, at least when using Søderberg anode, is supplied near the sidewall of the electrolytic cell.

Finally, in the electrolytic cell of the present invention, the operating temperature and the composition of the electrolytic bath can be more freely chosen to optimize cell efficiency, since the sidewall temperature can be adjusted independently of the electrolytic bath temperature by the evaporation cooled panels to maintain an ideal temperature difference to the electrolytic bath. Thus, for instance, the fluoride content of the electrolytic bath can be increased resulting in a faster dissolution of aluminum oxide added to the electrolytic bath, and the current density of each cell can be optimized without taking possible sidewall attack into consideration.

The present invention is further directed to a method for maintaining a crust on a sidewall of an electrolytic cell used for producing aluminum. This method is characterized in that one or more evaporation cooled panels are arranged on the inside of the electrolytic cell such that one side of the panels is in contact with a molten bath inside the cell and the other side is in contact with a high temperature, heat resistant and heat insulating material, the insulating material being in contact with a steel shell of the cell. The evaporation cooled panels have a first cooling medium wherein the temperature of the cooling medium is maintained such that the temperature of one side of the panel is slightly below the temperature of the molten bath, thereby forming a crust on the side of the panel.

As noted above, it is preferred that the temperature on one side of the panel be about 2 to about 50° C. below the temperature of the molten bath. In this way, the proper thickness of the crust is maintained, i.e. neither too thick nor too thin.

The temperature of the first cooling medium is maintained by means of a second cooling medium which is circulated through a first cooled loop such that heat is exchanged between the first cooling medium and the second cooling medium. To cool the second cooling medium, heat is exchanged between the second cooling medium and a third cooling medium by means of a heat exchanger.

In order to control the temperature of the first cooling medium and, likewise, the temperature of the side of the panel facing the molten bath, the amount of second cooling medium or the temperature of the second cooling medium that exchanges heat with the first cooling medium is controlled either with valves or with a heating unit.

Finally, in order to provide energy efficiency to the overall method, heat is recovered from the third cooling medium as electrical energy by means of a gas turbine connected to an electrical generator.

The present invention also teaches a method for recovering electricity from an electrolytic cell used for the manufacture of aluminum. This method is characterized in that one or more evaporation cooled panels is in contact with a molten bath inside the cell and the other side is in contact with a high temperature, heat resistant and heat insulating material, the insulating material being in contact with a steel shell of the cell. The evaporation cooled panels have a first cooling medium and the tempeature of the first cooling medium is such that the temperature of one side of the panel is slightly below the temperature of the molten bath, thereby forming a crust on the side of the panel. Heat from the first cooling medium is recovered and transferred into electrical energy.

More particularly, the temperature of the first cooling medium is maintained by means of a second cooling medium which is circulated through a first closed loop such that heat is exchanged between the first cooling medium and the second cooling medium. Heat is also exchanged between the second cooling medium and a third cooling medium by means of a heat exchanger. Heat is removed from the third cooling medium by means of a gas turbine connected to an electrical generator so as to generate electricity.

SHORT DESCRIPTION OF THE DRAWINGS

Figure 2:
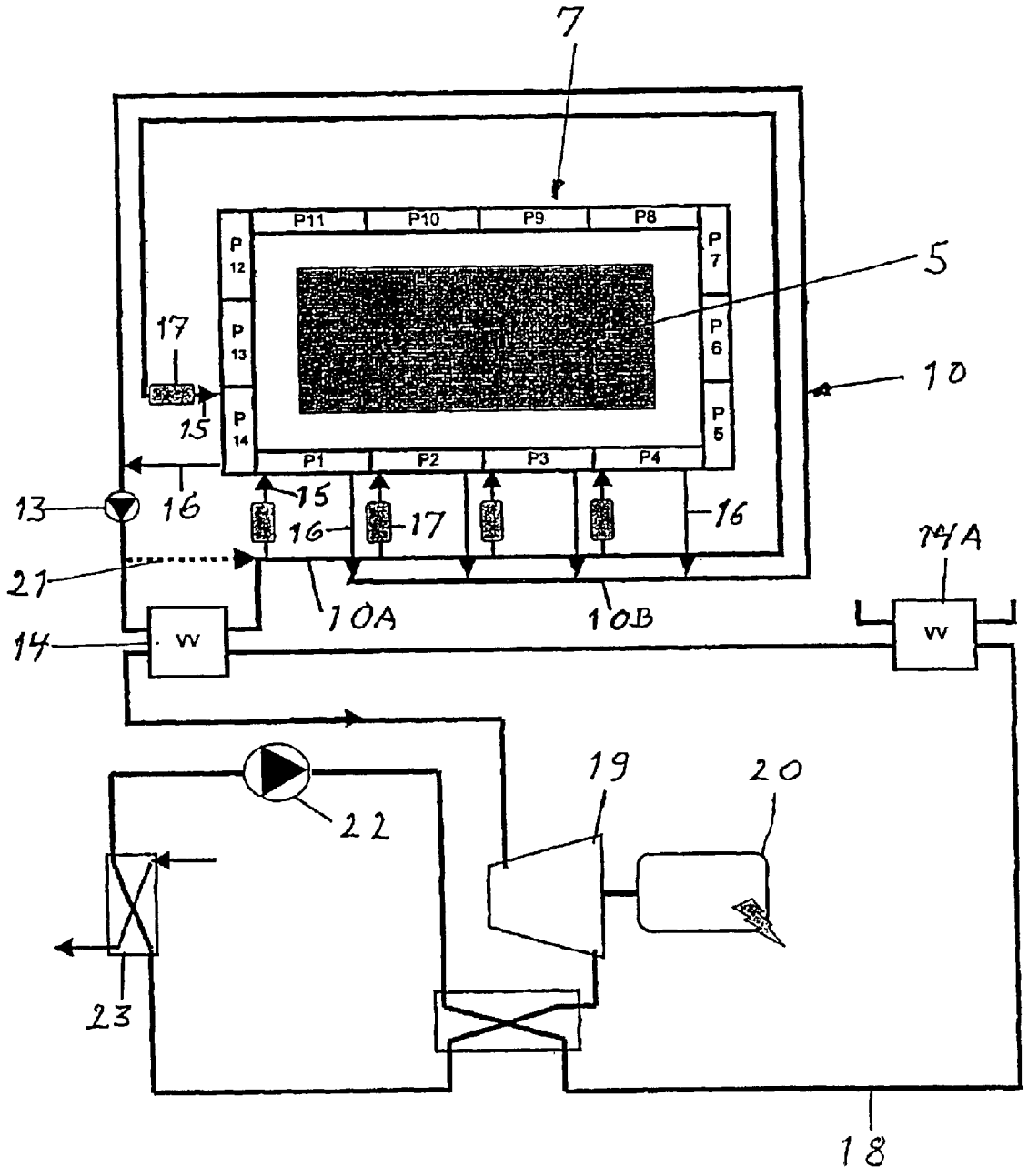
Figure 3:
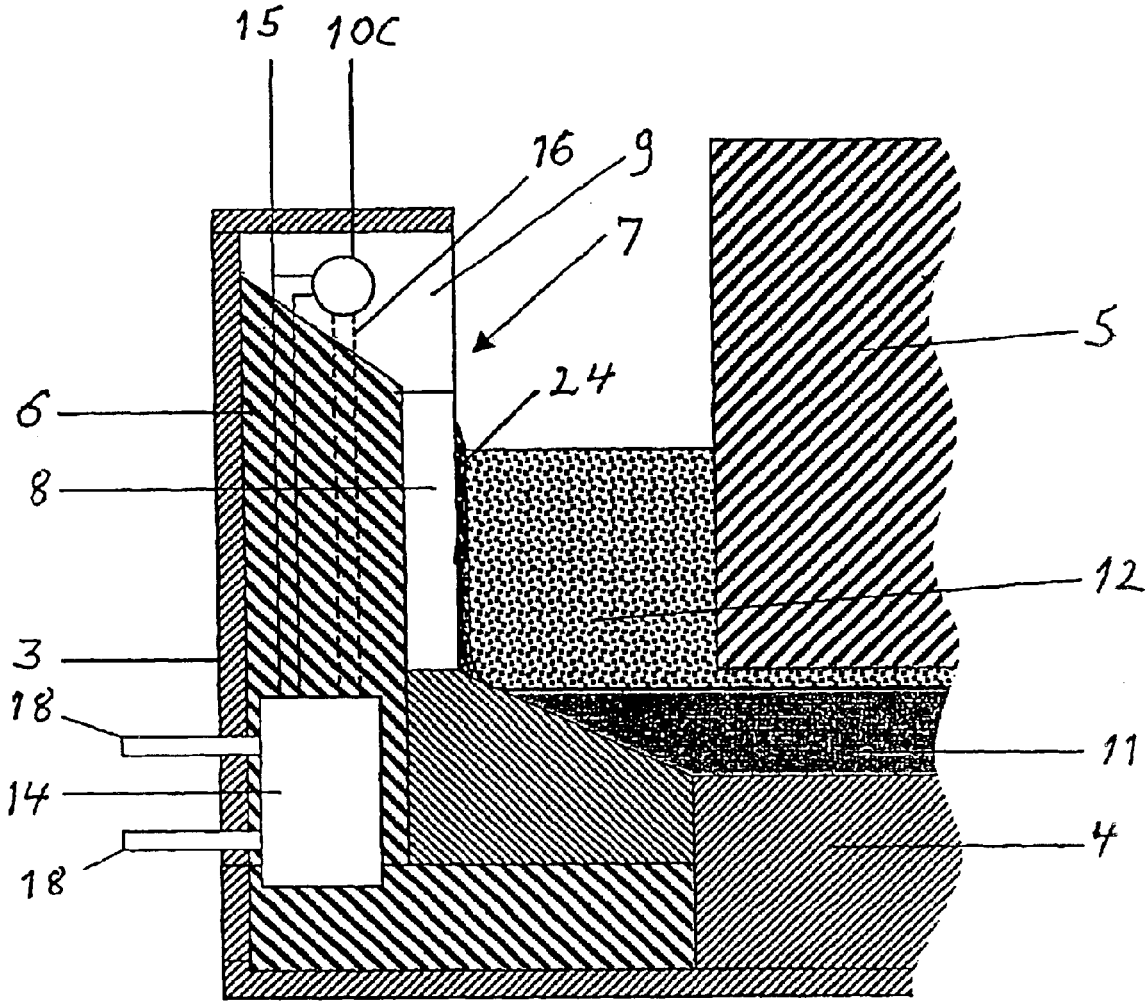

FIG. 1 shows a vertical cut through part of an electrolytic cell according to the invention, FIG. 2 shows schematically a top view of an electrolytic cell according to the present invention with arrangements of cooling circuits; and FIG. 3 shows a vertical cut through part of a preferred electrolytic cell according to the invention.

DETAILED DESCRIPTION OF THE INVENTION

In FIG. 1 there is shown an electrolytic cell 1 for the production of aluminum. The electrolytic cell comprises an electrolytic tank 2 having an outer shell 3 made from steel. In the bottom of the steel shell 3 there are arranged carbon blocks 4 which are connected to electric terminals (not shown) said carbon blocks constituting the cathode of the electrolytic cell. An anode 5 is arranged above and spaced apart from the carbon blocks 4. The anode 5 is preferably prebaked carbon anode blocks or a self-baking carbon anode, also called a Søderberg anode. The anode 5 is suspended from above in conventional manner (not shown) and connected to electrical terminals.

Inside the steel shell 3 on the sidewalls of the electrolytic tank there is arranged a layer of heat insulating refractory material 6 and on the inside of the layer of heat insulating refractory material 6 there is arranged an evaporation cooled panel 7 facing the inside of the electrolytic cell. The evaporation cooled panel is preferably made from non-magnetic steel. The evaporation cooled panel 7 consists of a lower part 8 intended to contain a first cooling medium in liquid state, said first cooling medium having a melting point below the operating temperature of the electrolytic cell and a boiling point around the operating temperature of the electrolytic cell. A preferred cooling medium is sodium, but other cooling media satisfying the above requirements may be used.

The evaporation cooled panel 7 has an upper part 9 for condensing cooling liquid evaporated from the lower part 8 of the evaporation cooled panel 7. The condensing of evaporated cooling medium in the upper part 9 of the evaporation cooled panel 7 takes place by circulating a second cooling medium having a lower temperature than the first cooling medium contained in the evaporation cooled panel 7, through a pipe 10C, which forms part of a first closed cooling loop 10, passing through the interior of the upper part 9 of the evaporation cooled panel 7.

When in operation, the electrolytic cell contains a lower layer 11 of molten aluminum and an upper layer 12 of cryolite-based molten electrolytic bath 12.

Aluminum oxide is in conventional way supplied to the electrolytic bath 12 and is dissolved in the bath 12.

In FIG. 2 there is schematically shown a top view of an electrolytic cell according to the invention with arrangements for cooling circuits.

Evaporation cooled panels 7 covering the complete area of the sidewalls are shown as P1 through P14. To make the drawing more easy to understand, the refractory heat insulating material and the outer steel shell are not shown in FIG. 2. The anode 5 shown in FIG. 2 is a Søderberg type anode.

The first closed loop for circulating a second cooling medium, which preferably is carbon dioxide, nitrogen, helium or argon is shown by reference numeral 10. A pump 13 is arranged in the first closed loop for circulating the second cooling medium and a heat exchanger 14 is arranged through which the second cooling medium is circulated. The first closed loop 10 has branches 15 and 16 running into and out of the upper part 9 of each of the evaporation cooled panels 7. Only a few of the branches 15 and 16 are shown in FIG. 2. On each of the branches 15 running into the upper part 9 of the evaporation cooled panels 7, there are arranged heating elements 17.

The first closed loop 10 for circulating the second cooling medium works in the following way:

When the second cooling medium passes through the heat exchanger 14 heat is transferred from the second cooling medium to a third cooling medium in order to obtain a preset temperature of the second cooling medium when it has passed through the heat exchanger. The third cooling medium is in the second closed loop 18. In order to further control the temperature of the second cooling medium there is preferably arranged a by-pass circuit 21, making it possible to by-pass a part of the second cooling medium outside the heat exchanger 14.

A part of the second cooling medium flows into the evaporation cooled panel P1 through the branch 15 where the second cooling medium is heated due to the heat of condensation of the first cooling medium in the evaporation cooled panel P1. Thereafter, the second cooling medium flows out of the evaporation cooled panel P1 through the branch 16 and into the main conduit 10. This is done for all evaporation cooled panels P1 through P14. The second cooling medium which has been heated in each of the evaporation cooled panels P1 through P14 then flows through the heat exchanger 14 where the temperature of the second cooling medium again is reduced.

The amount of heat transferred to the second cooling medium during condensation of the first cooling medium in the upper part 9 of the evaporation cooled panels may vary from one evaporation cooled panel 7 to another evaporation cooled panel 7, and the amount of heat transferred to the second cooling medium for each evaporation cooled panel 7 may also vary with time. It is therefore preferred to include means for individual control of either the temperature or the amount of the second cooling medium which enters into the pipe 10C inside each evaporation cooled panel 7. In one embodiment, this is done by arranging electric heating elements 17 on each of the branches 15. The heating elements 17 are individually controlled, preferably based on temperatures measured by thermocouples arranged in each evaporation cooled panel 7.

In another embodiment, there are arranged individually controlled valves in each branch 15 which increase or decrease the amount of second cooling liquid flowing in the branches 15 based on the temperature in each individual evaporation cooled panel 7.

In this way the temperature in the first cooling medium in the lower part 8 of each evaporation cooled panel 7 is locked at a preset temperature or within a preset temperature interval.

In order to remove heat from the second cooling medium as it passes through the heat exchanger 14, there is arranged a second closed cooling loop 18 for transporting a third cooling medium having a lower temperature than the temperature of the second cooling medium as it passes through the heat exchanger 14. The third cooling medium circulating in the closed loop 18 is preferably a gas. After having been heated in the heat exchanger 14 the gas is forwarded to a turbine 19 connected to a generator 20 for generating electricity. The cooled gas leaving the turbine 19 is then returned to the heat exchanger 14. The thermal energy in the gas is converted to electric energy in the generator 20 at an efficiency of 45% or more.

The second closed loop 18 for circulating the third cooling medium is preferably connected to the heat exchangers 14 for a plurality of electrolytic cells, and more preferably to the heat exchangers 14 for all electrolytic cells in a potline. This is indicated in FIG. 2 where there is shown a second heat exchanger 14A for a second electrolytic cell.

The electricity produced in generator 20 results in a substantial reduction of the effective energy consumed in the electrolytic cell per ton produced aluminum.

The second closed loop 18 has a pump 22 for circulating the third cooling medium and a conventional bleed arrangement 23.

As noted above, it is preferred that the majority of parts of the first closed loop 10 and the heat exchanger 14 are arranged in the heat resistant and heat insulating material 6. This preferred embodiment is illustrated in FIG. 3 wherein each electrolytic tank has an inlet and an outlet for connecting the piping of the second closed loop 18. The outflow pipe 10A and inflow pipe 10B of the first closed loop 10, as well as the portion of pipe 10C in the upper part 9 of evaporation cooled panel 7, are as shown. These connectors allow the third cooling medium to circulate through the heat exchanger 14. A crust 24 of frozen bath is then formed on the sidewalls of the cell.

What is claimed is:

1. In an electrolytic cell for the production of aluminum having an anode and an electrolytic tank wherein the electrolytic tank has an outer shell made from steel where carbon blocks in the bottom of the tank form the cathode of the electrolytic cell, and where high temperature, heat resistant and heat insulating material is arranged on the inside of the inner sidewalls part of the steel shell, the improvement comprising: at least a part of the sidewall of the electrolytic tank has one or more evaporation cooled panels positioned on at least a part of the heat resistant and heat insulating material that forms the sidewall such that one side of the evaporation cooled panels faces and is in contact with a molten bath on the inside of the tank such that a crust of molten bath is capable of forming on said one side of said panels and the other side of the evaporation cooling panels faces said heat resistant and heat insulating material.

2. Electrolytic cell according to claim 1, characterized in that all the sidewalls of the electrolytic cells are equipped with evaporation cooled panels.

3. Electrolytic cell according to claim 1, characterized in that the evaporation cooled panels are intended to contain a cooling medium having a boiling point at atmospheric pressure between 850 and 950° C.

4. Electrolytic cell according to claim 3, characterized in that the evaporation cooled panels are intended to contain molten sodium, molten sodium-lithium alloy or molten zinc as a cooling medium.

5. Electrolytic cell according to claim 1, characterized in that each evaporation cooled panel has means in its upper part for circulation of a second cooling medium for convective cooling to condense the cooling medium in the evaporation cooled panel.

6. Electrolytic cell according to claim 5, characterized in that the means for circulation of the second cooling medium is a first closed loop, said first closed loop running through the upper part of each evaporation cooled panel in the electrolytic cell.

7. Electrolytic cell according to claim 6, characterized in that the parts of the first closed loop for the second cooling medium that are not inside the upper part of the evaporation cooled panels are arranged in the heat resistant and heat insulating material arranged between the evaporation cooled panels and the steel shell.

8. Electrolytic cell according to claim 7, characterized in that the first closed loop for circulating the second cooling medium is connected to a heat exchanger for transferring heat from the second cooling medium to a third cooling medium contained in a second closed loop.

9. Electrolytic cell according to claim 8, characterized in that the heat exchanger is arranged in the heat resistant and heat insulating material between the evaporation cooled panels and the steel shell.

10. Electrolytic cell according to claim 8, characterized in that the second closed loop for circulating the third cooling medium is connected to a turbine and a generator for converting thermal energy to electric energy.

11. Electrolytic cell according to claim 5, characterized in that means are arranged for adjusting the temperature of the second cooling medium before it enters into the upper part of each evaporation cooled panel.

12. Electrolytic cell according to claim 11, characterized in that the means for adjusting the temperature of the second cooling medium is electric heating elements.

13. Electrolytic cell according to claim 11, characterized in that in that the means for adjusting the temperature of the second cooling medium is adjustable valves.

14. Electrolytic cell according to claim 11, characterized in that the mean for adjusting the temperature of the second cooling medium is by-pass conduits with adjustable valves.

15. A potline having a plurality of electrolytic cells for production of aluminum characterized in that:

a) each electrolytic cell comprises an anode and an electrolytic tank wherein the electrolytic tank has an outer shell made from steel, carbon blocks in the bottom of the tank forming the cathode of the electrolytic cell, heat resistance and heat insulating material arranged on all of the sidewalls of the tank, and one or more evaporation cooled panels positioned on at least a part of the heat resistant and heat insulating material that forms the sidewall such that one side of the evaporation cooled panel faces and is in contact with a molten bath on the inside of the tank, and the other side of the evaporation cooling panel faces said heat resistant and heat insulating material a first cooling medium contained within said evaporation cooled panel, a first closed loop circulating a second cooling medium, a part of the first closed loop running through the upper part of the evaporation cooled panel for cooling the first cooling medium and the parts of the first closed loop that are not inside the upper part of the evaporation cooled panel are arranged in the heat resistant and heat insulating material and a heat exchanger connected to the first closed loop and positioned in the heat resistant and heat insulating material; and b) a second closed loop connected to the heat exchanger of each electrolytic cell in the potline, a third cooling medium circulating in the second closed loop, the heat exchanger transferring heat from the second cooling medium to the third cooling medium such that a crust of molten bath is capable of forming on said one side of said panel.

16. Potline according to claim 15, characterized in that the second closed loop for circulating the third cooling medium is connected to a turbine and a generator for converting thermal energy to electric energy.

17. A method for maintaining a crust on a sidewall of an electrolytic cell used for producing aluminum, characterized in that:

(a) one or more evaporation cooled panels are arranged on the inside of the electrolytic cell such that one side of the panels is in contact with a molten bath inside the cell and the other side is in contact with a high temperature, heat resistant and heat insulating material, the insulating material being in contact with a steel shell of the cell, the panels having a first cooling medium therein; and (b) the temperature of the first cooling medium in the evaporation cooled panels is maintained such that the temperature of the one side of the panels is slightly below the temperature of the molten bath, thereby forming a crust of molten bath on the one side of panels.

18. Method according to claim 17, characterized in that the temperature on the one side of the panel is about 2 to about 50° C. below the temperature of the molten bath.

19. Method according to claim 17, characterized in that the temperature of the first cooling medium is maintained by means of a second cooling medium which is circulated through a first closed loop such that heat is exchanged between the first cooling medium and the second cooling medium; and that heat is also exchanged between the second cooling medium and a third cooling medium by means of a heat exchanger, thereby cooling the second cooling medium.

20. Method according to claim 19, characterized in that the amount of second cooling medium or the temperature of the second cooling medium that exchanges heat with the first cooling medium is effective to control the temperature of the first cooling medium.

21. Method according to claim 19, characterized in that heat is recovered from the third cooling medium as electrical energy.

22. A method for recovering electricity from an electrolytic cell used for producing aluminum and for maintaining a crust on a sidewall of the electrolytic cell, characterized in that:

(a) one or more evaporation cooled panels are arranged on the inside of the electrolytic cell such that one side of the panels is in contact with a molten bath inside the cell and the other side is in contact with a high temperature, heat resistant and heat insulating material, the insulating material being in contact with a steel shell of the cell, the panels having a first cooling medium therein;

(b) the temperature of the first cooling medium in the evaporation cooled panels is maintained in order to keep the temperature of the one side of the panels slightly below the temperature of the molten bath, thereby forming a crust of molten bath on the one side of the panels by means of a second cooling medium which is circulated in a first closed loop such that heat is exchanged between the first cooling medium and the second cooling medium; and (c) heat is exchanged between the second cooling medium and a third cooling medium by means of a heat exchanger, thereby cooling the second cooling medium; and that heat is removed from the third cooling medium by means of a gas turbine and an electrical generator so as to generate electricity.

* * * * *